US007517064B2

(12) United States Patent
Sugahara

(10) Patent No.: US 7,517,064 B2
(45) Date of Patent: Apr. 14, 2009

(54) LIQUID TRANSPORTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 513 days.

(21) Appl. No.: 11/437,636

(22) Filed: May 22, 2006

(65) Prior Publication Data

US 2006/0262167 A1 Nov. 23, 2006

(30) Foreign Application Priority Data

May 20, 2005 (JP) ..... 2005-148162

(51) Int. Cl.
*B41J 2/045* (2006.01)

(52) U.S. Cl. ..... 347/70

(58) Field of Classification Search ..... 347/70, 347/68–69, 71–72

See application file for complete search history.

(56) References Cited

U.S. PATENT DOCUMENTS 6,971,738 B2 12/2005 Sugahara
7,121,651 B2 * 10/2006 Takahashi et al. ..... 347/71
2005/0068377 A1 * 3/2005 Ishikawa et al. ..... 347/68

FOREIGN PATENT DOCUMENTS

| | | |
|---|---|---|
| JP | H11300971 | 11/1999 |
| JP | 2004166463 | 6/2004 |
| JP | 2004209874 | 7/2004 |

* cited by examiner

*Primary Examiner*—K. Feggins
(74) *Attorney, Agent, or Firm*—Baker Botts L.L.P.

(57) ABSTRACT

A piezoelectric actuator of an ink-jet head as a liquid transporting apparatus includes a vibration plate which also serves as a common electrode, a piezoelectric layer arranged on the vibration plate on a side opposite to pressure chambers, and individual electrodes arranged on a surface of the piezoelectric layer on a side opposite to the vibration plate, at areas each of which overlaps in a plan view with an edge portion of one of the pressure chambers. Recesses are formed on a surface of the vibration plate on the side opposite to the pressure chamber, at areas each of which overlaps with a central portion of one of the pressure chambers, and a stiffness of the vibration plate is reduced partially. Therefore, the vibration plate can be deformed substantially at a low drive voltage. Accordingly, a liquid transporting apparatus which includes the piezoelectric actuator having excellent drive efficiency is provided.

11 Claims, 13 Drawing Sheets

LIQUID TRANSPORTING APPARATUS

BACKGROUND OF THE INVENTION

1. Field of the Invention

The present invention relates to a liquid transporting apparatus which transports a liquid by applying a pressure to the liquid.

2. Description of the Related Art

Ink-jet heads having various structures have been proposed or put to practical use as ink-jet heads which transport ink to nozzles, and discharge the ink from the nozzles to a recording paper. Among these structures, an ink-jet head described in U.S. Pat. No. 6,971,738 B2 (corresponding to Japanese Patent Application Laid-open Publication No. 2004-166463) includes a channel unit (cavity plate) in which a plurality of pressure chambers communicating with nozzles is formed, and a piezoelectric actuator which applies a pressure to ink in the pressure chambers to change volume of the pressure chambers, thereby discharging ink from the nozzles.

The piezoelectric actuator of this ink-jet head includes a plurality of piezoelectric sheets which are made of a lead zirconate titanate (PZT) and are arranged to cover the pressure chambers, and individual electrodes (drive electrodes) and common electrodes which are arranged alternately between these piezoelectric sheets. The individual electrodes and common electrodes are formed in an annular form (ring form) in an area on an inner side of each of the pressure chambers along an edge thereof, as seen from a direction orthogonal to a plane of the piezoelectric sheets.

The piezoelectric actuator is structured to easily perform a so-called pulling ejection in which, after drawing ink into the pressure chamber by increasing a volume of the pressure chamber once, a substantial pressure is applied to the ink by returning the volume of the pressure chamber to its original volume. In other words, in a state that the common electrodes are kept at a ground electric potential, when a drive voltage is applied to the individual electrodes, an annular portion (ring portion) of each of the piezoelectric sheets overlapping with the edge of the pressure chamber, which is sandwiched between the individual electrode and the common electrode, is contracted in a direction parallel to a plane of the piezoelectric sheet. As a result of this, the piezoelectric sheets are deformed to project in a direction opposite to the pressure chamber. Due to the deformation of the piezoelectric sheets, the volume inside the pressure chamber is increased, and a negative pressure wave is generated inside the pressure chamber. Furthermore, when the application of the drive voltage to the individual electrodes is stopped at timing at which the pressure wave is changed to positive, the piezoelectric sheets are returned to their original shape, and the volume inside the pressure chamber is decreased as compared to the volume of the pressure chamber when the drive voltage is applied to the individual electrodes. When the volume inside the pressure chamber is decreased, the pressure wave generated with the increase in the volume of the pressure chamber and a pressure wave generated with the restoration of the piezoelectric sheet are combined, and a substantial pressure is applied to the ink. Therefore, this piezoelectric actuator can apply pressure efficiently to the ink at a comparatively low drive voltage. Further, the drive voltage is applied to the individual electrode and an electric field acts on the piezoelectric layers only at timing when the ink is discharged. Therefore, at timing other than the timing when the ink is discharged, the electric field is not applied to the piezoelectric layer, and polarization deterioration hardly occurs in the piezoelectric layers. Therefore, a durability of the actuator is also enhanced.

SUMMARY OF THE INVENTION

However, in a piezoelectric actuator such as a piezoelectric actuator described in U.S. Pat. No. 6,971,738 B2, when a stiffness in an area overlapping with a pressure chamber (particularly, an area which overlaps with a central portion of the pressure chamber, and in which no individual electrode is formed) is high, the piezoelectric sheet as a whole is hardly deformed, and an amount of deformation is small. In this case, higher drive voltage consequently needs to be applied to an individual electrode for applying a predetermined pressure to ink in the pressure chamber, and an electric power consumption of the piezoelectric actuator becomes high. Therefore, for further improving the drive efficiency of the piezoelectric actuator, a structure which is capable of increasing an amount of deformation without increasing the drive voltage is demanded.

An object of the present invention is to provide a liquid transporting apparatus which includes a piezoelectric actuator having excellent drive efficiency.

According to a first aspect of the present invention, there is provided a liquid transporting apparatus including a channel unit which is arranged along a plane, and in which a channel including a plurality of pressure chambers each having a liquid inflow port and a liquid outflow port is formed; and a piezoelectric actuator which is arranged on one surface of the channel unit, and which changes volume of the pressure chambers to apply a pressure to a liquid inside the pressure chambers;

wherein the piezoelectric actuator includes: a vibration plate which covers the pressure chambers; a piezoelectric layer which is arranged on a side of the vibration plate opposite to the pressure chambers; a plurality of individual electrodes each of which is arranged on one surface of the piezoelectric layer at an area overlapping with an edge portion of one of the pressure chambers as viewed in a direction orthogonal to the plane, the edge portion being an area other than a central portion of one of the pressure chambers; and a common electrode which is arranged on the other surface of the piezoelectric layer; and wherein recesses are formed on a surface of the vibration plate on a side of the pressure chambers at areas each of which overlaps with the central portion of one of the pressure chambers as viewed in the direction orthogonal to the plane.

According to the first aspect of the present invention, in the liquid transporting apparatus of the present invention, the individual electrodes of the piezoelectric actuator are arranged in the areas each of which overlaps with the edge portion of one of the pressure chambers. Therefore, when a drive voltage is applied to the individual electrode, a portion of the piezoelectric layer along the edge portion of the pressure chamber, which is sandwiched between the individual electrode and the common electrode, is contracted in a direction parallel to a plane direction of the piezoelectric layer. At this time, the vibration plate is deformed to project in a direction opposite to the pressure chamber, with a portion overlapping with the central portion of the pressure chamber as an apex of the deformation. As a result of this, a volume of the pressure chamber is increased and a negative pressure wave is generated in the pressure chamber. Further, when the application of drive voltage to the individual electrode is stopped at timing at which the pressure wave is changed to positive in the pressure chamber, the vibration plate returns to an original shape, and the volume inside the pressure chamber is decreased. However, at this time, the pressure wave generated due to the increase in the volume of the pressure chamber and the pressure wave generated due to the restoration of the vibration plate are combined, and a substantial pressure is applied to the liquid in the pressure chamber. Therefore, it is possible to apply a high pressure to the liquid with a comparatively low drive voltage, and a drive efficiency of the piezoelectric actuator is improved. Further, an electric field acts on the piezoelectric layer by applying the drive voltage to the individual electrodes only at a time of transporting the liquid. Therefore, polarization deterioration hardly occurs in the piezoelectric layer.

Furthermore, the recesses are formed in the areas each of which overlaps with the central portion of one of the pressure chambers, the areas being on the surface of the vibration plate on a side of the pressure chambers (driven zones in each of which the individual electrode is not formed), and a thickness of the vibration plate where the recess is formed is partially reduced. Accordingly, a stiffness of the vibration plate at portions where the recesses are formed is reduced than the stiffness of the other portion of the vibration plate. Therefore, when the drive voltage is applied to the individual electrode and the piezoelectric layer is deformed, the vibration plate is easily deformed, thereby making it possible to increase an amount of deformation of the vibration plate and to improve the drive efficiency of the piezoelectric actuator. In the present application, the term "central portion of the pressure chamber" means an area which includes the central portion (center of gravity) of the pressure chamber in a plan view.

In the liquid transporting apparatus of the present invention, each of the pressure chambers may be formed to extend in a predetermined direction; the liquid inflow port and the liquid outflow port may be provided at both end portions in a longitudinal direction, respectively, of each of the pressure chambers; and an end portion of each of the recesses in the longitudinal direction may overlap partially with one of the liquid inflow port and the liquid outflow port as viewed in the direction orthogonal to the plane. In this case, in the pressure chamber, a flow of liquid without stagnation is generated from the liquid inflow port up to the liquid outflow port via each of the recesses. Therefore, even when an air bubble is mixed in the pressure chamber, the air bubble hardly remains in the edge portion of the recess.

In the liquid transporting apparatus of the present invention, a width of the end portion of each of the recesses may be narrower than a central portion of each of the recesses, and the end portion of each of the recesses overlaps, as viewed in the direction orthogonal to the plane, with one of the liquid inflow port and the liquid outflow port, in a state in which the end portion is offset toward one side in a direction orthogonal to the longitudinal direction with respect to one of the liquid inflow port and the liquid outflow port. According to this structure, when the liquid flows from the liquid inflow port to each of the recesses or from each of the recesses to the liquid outflow port, a vortex flow is easily developed. Therefore, the air bubble hardly remains in the vicinity of the liquid inflow port or in the vicinity of the liquid outflow port.

In the liquid transporting apparatus of the present invention, the recesses may be shaped to be tapered toward a side of the piezoelectric layer. In this case, since an angle of a corner of the recess is greater than 90°, the air bubble hardly remains in this corner.

In the liquid transporting apparatus of the present invention, the channel unit may have a common liquid chamber communicating with the pressure chambers; each of the recesses may be extended up to an area which is outside of an area overlapping with one of the pressure chambers as viewed in the direction orthogonal to the plane; and a throttle channel, in which a channel area between the common liquid chamber and each of the pressure chambers becomes partially small, may be formed between the one surface of the channel unit and a portion of each of the recesses, the portion extending up to the area outside of the area overlapping with one of the pressure chambers.

The throttle channel provided between the common liquid chamber and each of the pressure chambers is for throttling back the flow so that the pressure wave generated in each of the pressure chambers is hardly propagated to the common liquid chamber or the like. However, a channel area (cross-sectional area) of the throttle channel has a substantial effect on the propagation of the pressure wave in the pressure chamber, and eventually on a transportation amount of the liquid or the like. Therefore, the throttle channel is required to be formed with high precision. Here, since the throttle channel is formed between the one surface of the channel unit and the part of each of the recesses, the throttle channel can be formed simultaneously by forming the recess in the vibration plate. Therefore, as compared to a case in which the throttle channel required to be formed separately from the recess with high precision is formed by a method such as a half etching, a manufacturing process can be simplified, and the yield is also improved.

In the liquid transporting apparatus of the present invention, the channel unit may include partition walls; each of the partition walls may form the throttle channel between each of the partition walls and one of the recesses, and each of the partition walls may define one side surface of one of the pressure chambers; and a surface of each of the partition walls, which defines the one side surface of one of the pressure chambers, may be an inclined surface inclined toward one of the pressure chambers in a direction away from the vibration plate. In this case, since the liquid is hardly stagnated in a corner formed by each of the partition walls and a bottom surface of one of the pressure chambers, the air bubble hardly remains in this corner.

In the liquid transporting apparatus of the present invention, each of the individual electrodes may be formed in an annular shape along the edge portion of one of the pressure chambers. In this structure, the piezoelectric layer is deformed over an entire circumference of the annular (ring) shaped area which is along the edge portion of the pressure chamber, and in which the individual electrode is formed. Therefore, the deformation of the vibration plate accompanied with the deformation of the piezoelectric layer is increased, and the drive efficiency of the piezoelectric actuator is improved.

In the liquid transporting apparatus of the present invention, the vibration plate may be formed of an electroconductive material, and may serve also as a common electrode. In this case, as compared to a case in which the vibration plate and the common electrode are formed by different members, the number of parts or components can be reduced. Further, the vibration plate may be made of a metallic material. In this case, a satisfactory conduction can be allowed over the entire vibration plate.

In the liquid transporting apparatus of the present invention, the piezoelectric actuator may increase the volume of the pressure chambers when a predetermined voltage is applied to the individual electrodes. In this case, it is possible to perform a so-called pulling ejection, and to improve the drive efficiency of the liquid transporting apparatus.

According to a second aspect of the present invention, there is provided an ink-jet printer which includes the liquid transporting apparatus of the present invention. According to the second aspect of the present invention, by using the liquid transporting apparatus of the present invention in an ink discharge section of the ink-jet printer, printing can be performed at a low electric power.

DETAILED DESCRIPTION OF THE PREFERRED EMBODIMENTS

Figure 1:
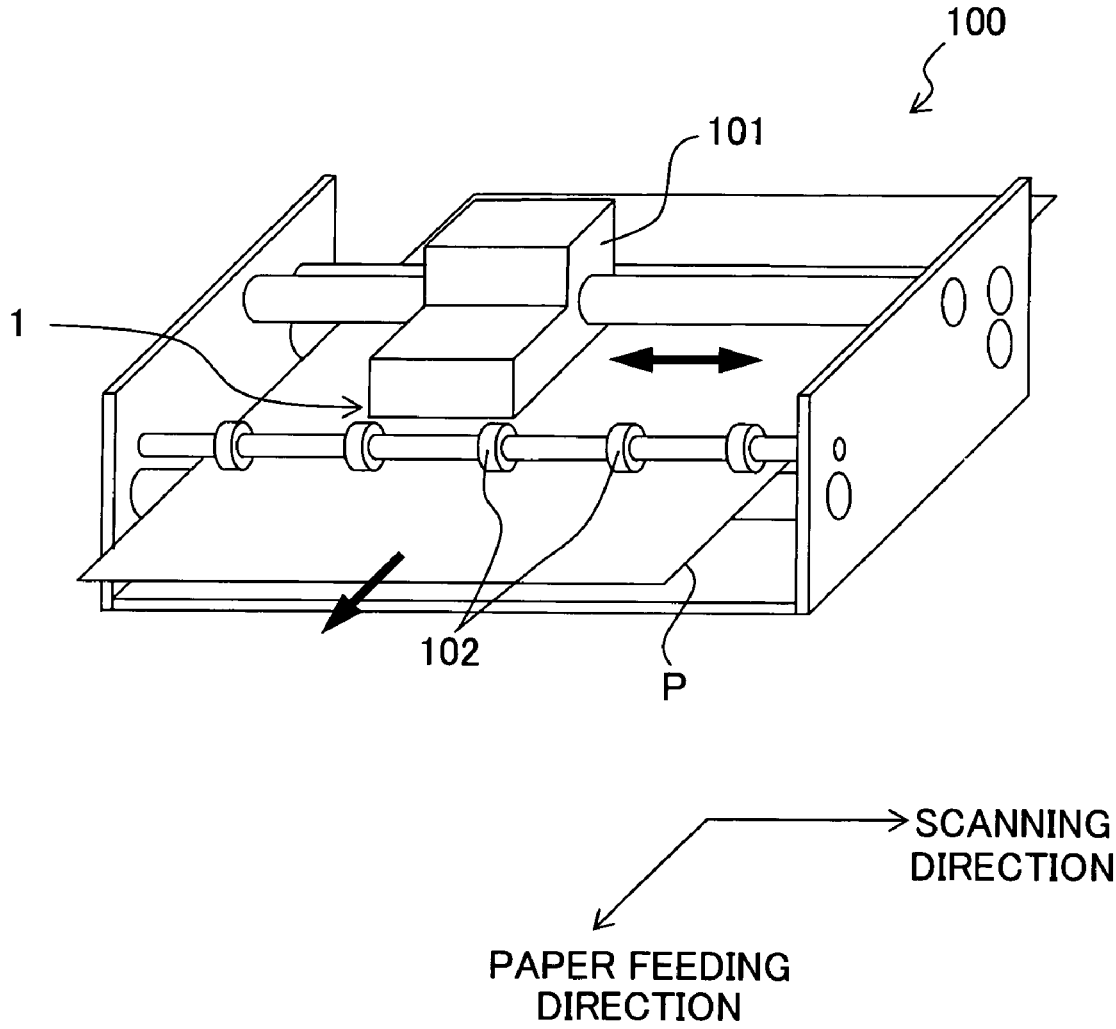
FIG. 1 is a schematic structural diagram of an ink-jet printer according to a first embodiment of the present invention.

A first embodiment of the present invention will be explained below. The first embodiment is an example in which the present invention is applied to an ink-jet head which discharges ink from nozzles, as a liquid transporting apparatus. Firstly, an ink-jet printer 100 which includes an ink-jet head 1 will be described briefly. As shown in FIG. 1, the ink-jet printer 100 includes a carriage 101 which is movable in a scanning direction (left and right direction) in FIG. 1, the ink-jet head 1 of a serial type which is provided on the carriage 101 and which discharges ink onto a recording paper P, and transporting rollers 102 which feed or transport the recording paper P in a forward direction in FIG. 1. The ink-jet head 1 moves integrally with the carriage 101 in the scanning direction and discharges ink onto the recording paper P from ejecting ports of nozzles 20 (see FIGS. 2 to 5) formed in an ink discharge surface of a lower surface of the ink-jet head 1. The recording paper P, with a character and/or an image recorded thereon with the ink-jet head 1, is discharged forward in a paper feeding direction by the transporting rollers 102.

Next, the ink-jet head 1 will be explained in detail. As shown in FIGS. 2 to 5, the ink-jet head 1 includes a channel unit 2 in which an ink channel is formed, and a piezoelectric actuator 3 which is arranged on an upper surface of the channel unit 2.

The channel unit 2 will be explained below. The channel unit 2 includes a cavity plate 10, a base plate 11, a manifold plate 12, and a nozzle plate 13, and these four plates are joined in stacked layers. Among these four plates, the cavity plate 10, the nozzle plate 11, and the manifold plate 12 are stainless steel plates having a substantially rectangular shape. Therefore, an ink channel such as a pressure chamber 14 and a manifold 17 which will be described later, can be formed easily by an etching in these three plates 10 to 12. Further, the nozzle plate 13 is formed of a high-molecular synthetic resin material such as polyimide, and is joined to a lower surface of the manifold plate 12. Alternatively, the nozzle plate 13 may also be formed of a metallic material such as stainless steel, similar to the three plates 10 to 12.

As shown in FIGS. 2 to 5, in the cavity plate 10, a plurality of pressure chambers 14 arranged along a plane are formed, and the pressure chambers 14 are open toward a vibration plate 30 (upward in FIGS. 4 and 5) which will be described later. Further, the pressure chambers 14 are arranged in two rows in the paper feeding direction (up and down direction in FIG. 2). Each of the pressure chambers 14 is formed to have a substantially elliptical shape which is long in the scanning direction (left and right direction in FIG. 2) in a plan view.

Figure 2:
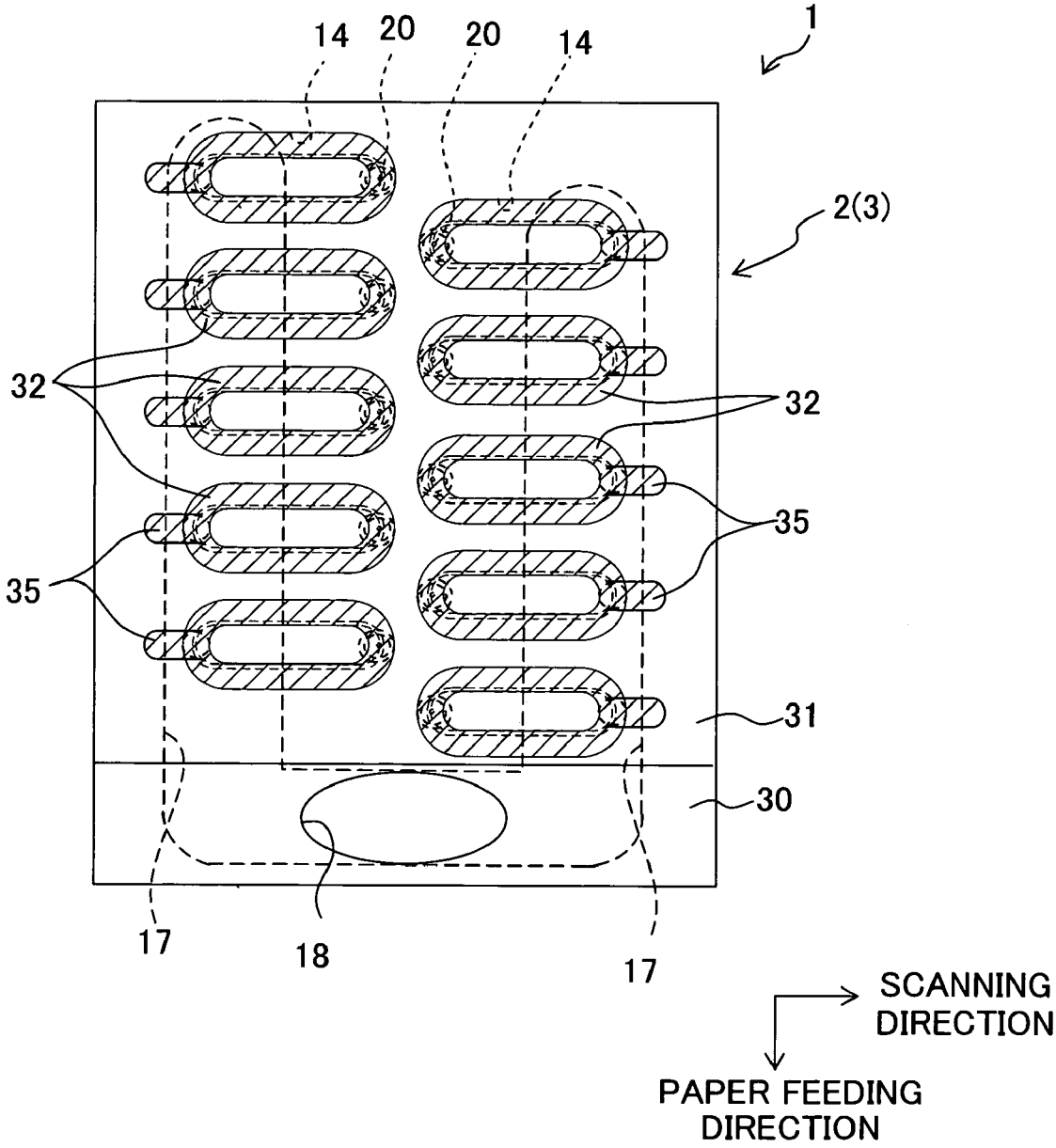
FIG. 2 is a plan view of the ink-jet head.
Figure 3:
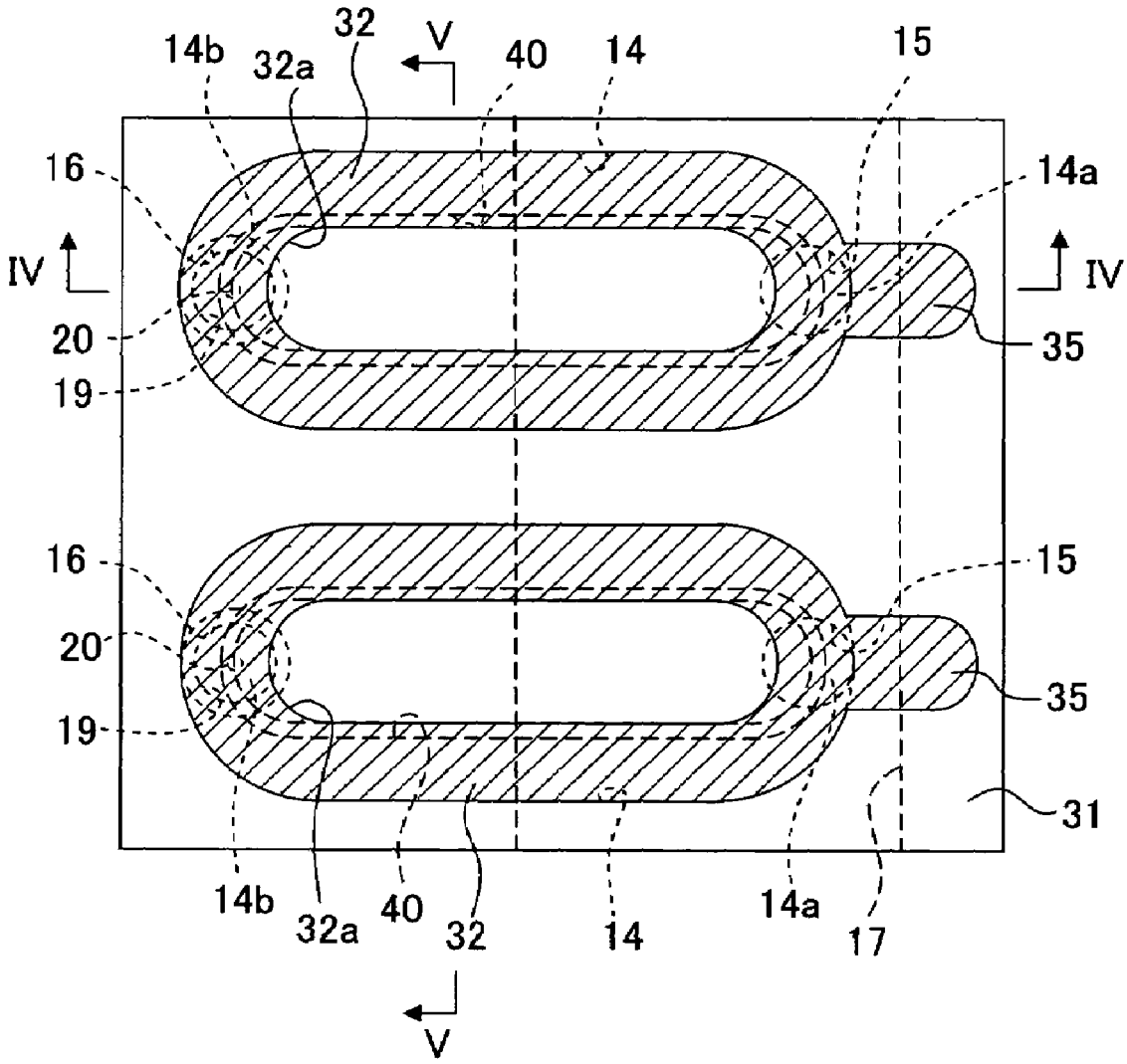
FIG. 3 is a partially enlarged diagram of FIG. 2.
Figure 4:
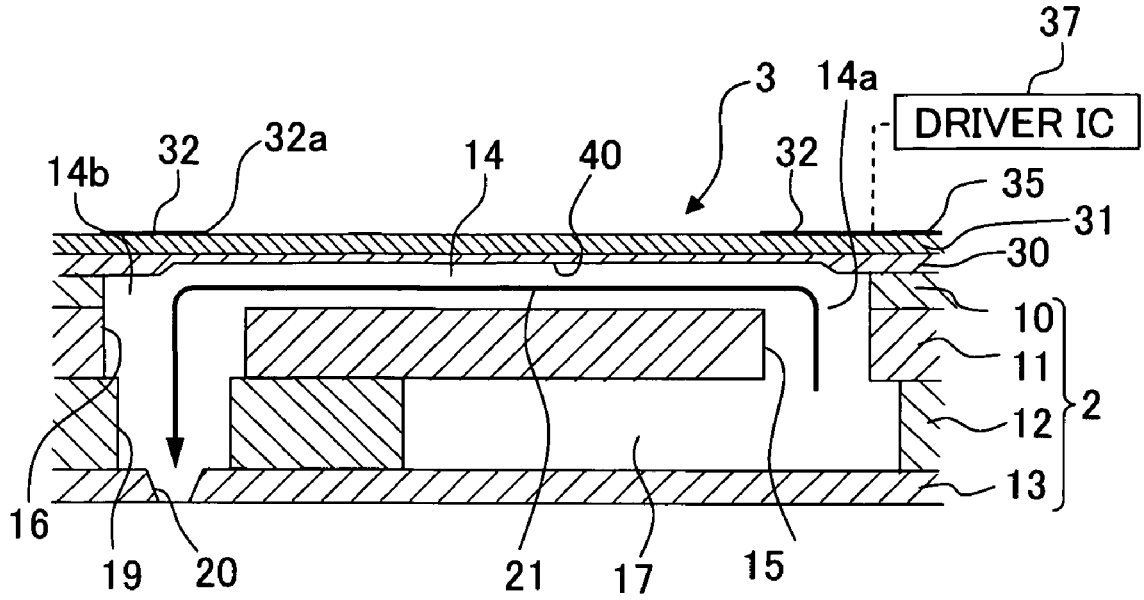
FIG. 4 is a cross-sectional view taken along a line IV-IV in FIG. 3.

As shown in FIGS. 3 and 4, communicating holes 15 and 16 are formed in the base plate 11 at positions which overlap in a plan view with both end portions, respectively, in the longitudinal direction of each of the pressure chambers 14 (as viewed in a direction orthogonal to the plane in which the pressure chambers 14 are arranged). Openings of the communicating holes 15 and 16, on the side of the pressure chamber 14, have a circular shape in a plan view, and form an ink inflow part 14*a* (liquid inflow port) and an ink outflow port 14*b* (liquid outflow port), respectively, of each of the pressure chambers 14. Further, in the manifold plate 12, a manifold 17 which is extended in the paper feeding direction (up and down direction in FIG. 2) is formed. As shown in FIGS. 2 to 4, the manifold 17 is arranged to overlap with left halves of the pressure chambers 14 arranged on a left side, and right halves of the pressure chambers 14 arranged on a right side. Furthermore, the manifold 17 is connected to an ink supply port 18 formed in the vibration plate 30 which will be described later, and ink is supplied to the manifold 17 from an ink tank (omitted in the diagram) via the ink supply port 18. Communicating holes 19 communicating with the communicating holes 16 respectively are formed in the manifold plate 12 at positions each of which overlaps in a plan view with an end portion of one of the pressure chambers 14, the end portion being on a side of the pressure chamber opposite to the manifold 17. The nozzles 20 are formed in the nozzle plate 13 at positions each of which overlaps with one of the communicating holes 19 in a plan view. The nozzles 20 are formed by performing an excimer laser process on a substrate of a high-molecular synthetic resin material such as polyimide.

As shown in FIG. 4, the manifold 17 communicates with the ink inflow port 14*a* of each of the pressure chambers 14 via one of the communicating holes 15, and the ink outflow port 14*b* of each of the pressure chambers 14 communicates with one of the nozzles 20 via the communicating holes 16 and 19. Thus, individual ink channels 21 each from the manifold 17 up to one of the nozzles 20 via one of the pressure chambers 14 are formed in the channel unit 2.

Next, the piezoelectric actuator 3 will be described below. As shown in FIGS. 2 to 5, the piezoelectric actuator 3 includes a vibration plate 30, a piezoelectric layer 31, and a plurality of individual electrodes 32. The vibration plate 30 which is electroconductive is arranged on the upper surface of the channel unit 2. The piezoelectric layer 31 is formed on a surface on a side opposite to the pressure chambers 14 (upper surface) of the vibration plate 30. The individual electrodes 32 are formed on the upper surface of the piezoelectric layer 31, corresponding to the pressure chambers 14 respectively.

The vibration plate 30 is a plate having a substantially rectangular shape in a plan view, and is made of a metallic material (such as an iron alloy like stainless steel, a nickel alloy, an aluminum alloy, or a titanium alloy). The vibration plate 30 is joined to the cavity plate 10 such that the vibration plate 30 covers the pressure chambers 14. Further, the vibration plate 30 also serves as a common electrode which is arranged on a side of the lower surface of the piezoelectric layer 31, and which causes an electric field to act in the piezoelectric layer 31 between the individual electrodes 32 and the vibration plate 30. The vibration plate 30 is always kept at a ground electric potential.

Figure 5:
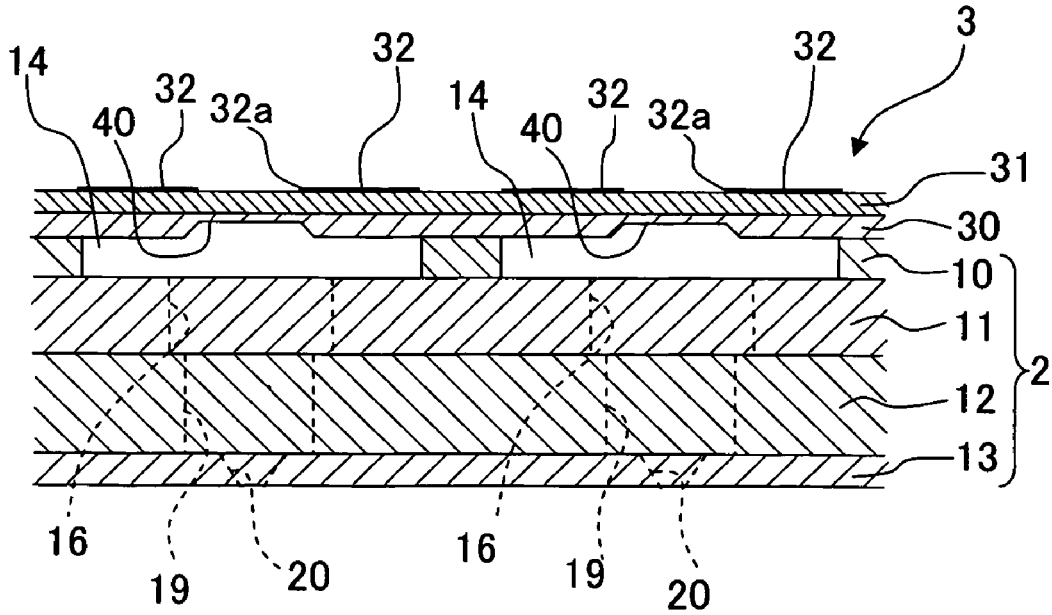
FIG. 5 is a cross-sectional view taken along a line V-V in FIG. 3.

Here, as shown in FIGS. 3 to 5, a recess 40, which is elliptical in shape and is smaller to some extent than each of the pressure chambers 14 is formed at an area in a surface (lower surface), of the vibration plate 30, on a side of the pressure chambers 14, the area overlapping in a plan view with a central portion of each of the pressure chambers 14. In this area in which the recess 40 is formed, a thickness of the vibration plate 30 is smaller than a thickness of the other portion of the vibration plate 30, and a stiffness of the vibration plate 30 is partially decreased. The recess 40 can be formed by using various processing methods such as a half etching and a press work. The recess 40 will be explained later in detail together with an action and effect thereof.

The piezoelectric layer 31 is made of lead zirconate titanate (PZT), which is a solid solution of lead titanate and lead zirconate and is a ferroelectric substance, is formed on an upper surface of the vibration plate 30 so as to entirely cover the pressure chambers 14. The piezoelectric layer 31 can be formed, for example, by an aerosol deposition method (AD method) in which particles of a piezoelectric material are jetted onto one surface of a substrate to deposit the particles on the one surface. Alternatively, the piezoelectric layer 31 can also be formed by other known methods such as a sputtering method, a CVD (chemical vapor deposition) method, a sol-gel method, and a hydrothermal synthesis method. Still alternatively, the piezoelectric layer 31 may be formed by cutting a piezoelectric sheet manufactured by baking a green sheet of PZT, to a predetermined size, and then adhering the cut piezoelectric sheet or sheets to the vibration plate 30.

In a central portion of each of the individual electrodes 32, a hole 32 a is formed. In other words, each of the individual electrodes 32 is formed at an area overlapping in a plan view with the edge portion of one of the pressure chambers 14, the edge portion being other than the central portion of one of the pressure chambers 14, and each of the individual electrodes 32 is formed in an annular shape (ring shape) along this edge. Each of the individual electrodes 32 is formed of an electroconductive material (such as gold, copper, silver, palladium, platinum, or titanium). Further, as shown in FIGS. 2 to 4, a terminal 35 is extended in the scanning direction (left and right direction in FIG. 2) from one end portion of each of the individual electrodes 32. A driver IC 37 is connected to the terminal 35 via a wiring member (omitted in the diagram) having a flexibility, such as a flexible printed circuit (FPC). The drive voltage is selectively applied from the driver IC 37 to each of the individual electrodes 32 via the terminal 35. The individual electrodes 32 and the terminal 35 of each of the individual electrodes 32 can be formed by a method such as a screen printing, the sputtering method, or a vapor deposition method.

Next, an action of the piezoelectric actuator 3 at a time of discharge of ink will be explained. When the drive voltage is selectively applied from the driver IC 37 to the individual electrodes 32, an electric potential of an individual electrode 32, which is on an upper side of the piezoelectric layer 31 and to which the drive voltage is applied, differs from the electric potential of the vibration plate 30 which is on the lower side of the piezoelectric layer 31, which serves as the common electrode and which is kept at a ground electric potential. At this time, an electric field parallel to a direction of thickness of the piezoelectric layer 31 is generated in an annular portion (ring-shaped portion), of the piezoelectric layer 31, along the edge portion of the pressure chamber 14, in other words, in a portion of the piezoelectric layer 31 sandwiched between the individual electrode 32 and the vibration plate 30. When a direction in which the piezoelectric layer 31 is polarized and the direction of the electric field are the same, the piezoelectric layer 31 is expanded in the direction of thickness which is a polarization direction, and is contracted in a direction parallel to a plane of the piezoelectric layer 31, which is a direction orthogonal to the polarization direction.

Figure 6:
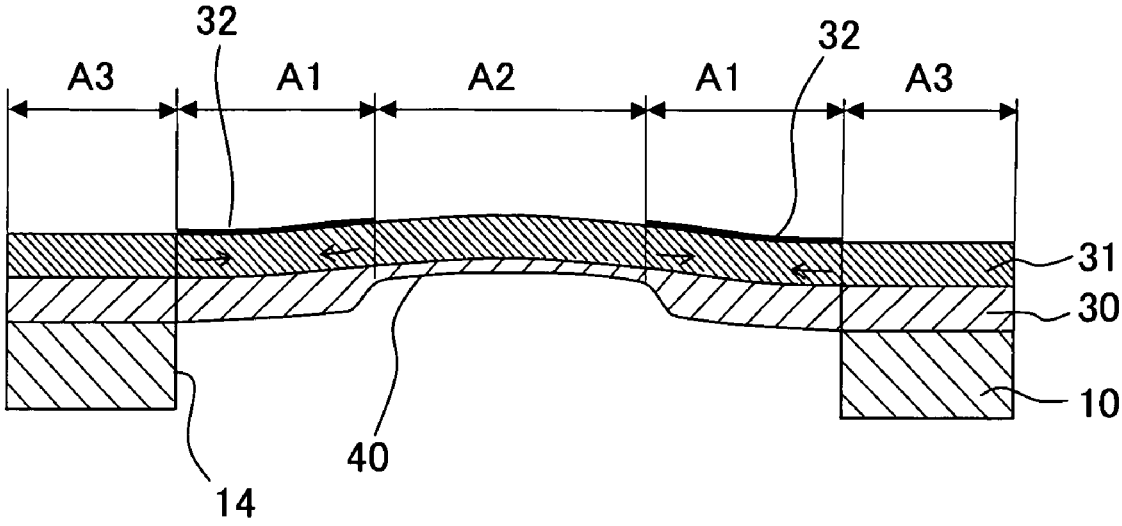
FIG. 6 is a diagram showing a deformed state of a vibration plate when an actuator is driven.

Here, as mentioned earlier, the individual electrode 32 is formed in the annular shaped area, of the piezoelectric layer 31, which overlaps with the edge portion of each of the pressure chambers 14. Accordingly, as shown in FIG. 6, the annular shaped area of the piezoelectric actuator 3 along the edge of each of the pressure chambers 14 becomes a driving zone A1 (active zone) in which the piezoelectric layer 31 is deformed by itself, and the area overlapping with the central portion of each of the pressure chambers 14 becomes a driven zone A2 (non-active zone) in which the piezoelectric layer 31 is deformed with the deformation of the piezoelectric layer 31 in the driving zone A1. Further, an area outside of each of the pressure chambers 14, at which the vibration plate 30 is joined to the cavity plate 10, becomes a constrained zone A3 in which the deformation of the vibration plate 30 is constrained. As shown in FIG. 6, while the piezoelectric layer 31 in the driving zone A1 is contracted in a direction parallel to the plane, the vibration plate 30 in the driving zone A1 is not contracted in the direction parallel to the plane. Therefore, the piezoelectric layer 31 and the vibration plate 30 in the driven zone A2 are deformed, and the vibration plate 30 is deformed to project in a direction opposite to the pressure chamber 14 with a center of the driven zone A2 as an apex of the deformation (unimorph deformation). In this case, the volume in the pressure chamber 14 is increased, and a negative pressure wave is generated in the pressure chamber 14.

Here, as hitherto known, when a time taken by the pressure wave generated due to the increase in the volume of the pressure chamber 14 for one way propagation in the longitudinal direction the pressure chamber 14 is elapsed, the pressure in the pressure chamber 14 is changed to positive. At this point, at the timing when the pressure in the pressure chamber 14 is changed to positive, the driver IC 37 stops the application of the drive voltage to the individual electrode 32. When the application of drive voltage is stopped, the electric potential of the individual electrode 32 becomes the ground electric potential, the vibration plate 30 returns to the original shape, and the volume in the pressure chamber 14 is decreased. At this time, however, the pressure wave generated with the increase in the volume of the pressure chamber 14 and the pressure wave generated with the restoration of the vibration plate 30 are combined, thereby applying a substantial pressure to the ink in the pressure chamber 14 to discharge the ink from the nozzle 20. Therefore, it is possible to apply a high pressure to the ink with a low drive voltage, and accordingly the drive efficiency of the piezoelectric actuator 3 is improved. Further, since the electric field is made to act in the piezoelectric layer 31 by applying the drive voltage to the individual electrode 32 only at timing when the ink is discharged, the polarization deterioration hardly occurs in the piezoelectric layer 31, and the piezoelectric layer 31 becomes highly durable.

Each of the individual electrodes 32 is formed in the annular shape along the edge portion of one of the pressure chambers 14, and the piezoelectric layer 31 is deformed over entire circumference of the annular area along the edge portion of the pressure chamber 14 in which the individual electrode 32 is formed. Therefore, as compared to a case in which each of the individual electrodes 32 is formed only in a part of the edge portion of one of the pressure chambers 14, an amount of deformation of the vibration plate 30 with the deformation of the piezoelectric layer 31 is increased.

Here, naturally, as the amount of deformation of the vibration plate 30 is greater, it is possible to apply higher pressure to the ink at a lower drive voltage, and the drive efficiency of the piezoelectric actuator 30 is improved. Further, for increasing the amount of deformation of the vibration plate 30, it is effective to lower the stiffness of the vibration plate 14 in the driven zone A2 in which the individual electrode 32 is not formed. Therefore, in the ink-jet head 1 of the first embodiment, as shown in FIGS. 2 to 6, the recess 40 which has an elliptical shape and which is smaller in size to some extent than each of the pressure chambers 14 is formed in the area overlapping with the central portion of each of the pressure chambers 14 (area facing the hole 32*a* of each of the individual electrodes 32), the area being in the vibration plate 30 on a surface (lower surface) on a side of the pressure chambers 14. In other words, in the driven zone 2A which overlaps with the central portion of each of the pressure chambers 14, a thickness of the vibration plate 30 is thinner (smaller) as compared to the other portion of the vibration plate 30. Here, since a bending stiffness of the plate material is proportional to a cube of a plate thickness, the thickness of the vibration plate 30 at a portion in which the recess 40 is formed becomes substantially low as compared to the other portion of the vibration plate 30 in which the recess 40 is not formed. Therefore, when the drive voltage is applied to the individual electrode 32, and a portion of the piezoelectric layer 31 corresponding to the driving zone A1 is deformed, the portion of the vibration plate 30 corresponding to the driven zone A2 is more easily to be deformed. Therefore, it is possible to apply the high pressure to the ink at a lower drive voltage, and the drive efficiency of the piezoelectric actuator 3 is improved. Further, by lowering the drive voltage, it is also possible to reduce a cost of the FPC and the driver IC 37 or the like for supplying the drive voltage to the individual electrodes 32. Furthermore, the stiffness of the portion of the vibration plate 30 in which the recess 40 is formed is lower than the stiffness of the portion other than the portion of the vibration plate formed with the recess 40. Therefore, as compared to a case in which the stiffness of the vibration plate 30 is uniform, the deformation of the portion of the vibration plate 30 in which the recess 40 is formed is hardly propagated to the portion of the vibration plate 30 which is joined to the cavity plate 10. Therefore, it is possible to suppress the propagation of the deformation of the vibration plate 30 up to a portion corresponding to the adjacent pressure chamber 14, thereby reducing a cross-talk.

Further, since the recess 40 is formed in the lower surface of the vibration plate 30, the upper surface of the vibration plate 30 is a flat and plane surface. Therefore, when the piezoelectric layer 31 is formed on the upper surface of the vibration plate 30 by using a method such as the aerosol deposition method, unevenness is hardly developed on the upper surface of the piezoelectric layer 31. In other words, since the individual electrode 32 is formed on the upper surface of the piezoelectric layer 31 which has little unevenness, it is also possible to obtain an effect that the formation of the individual electrode 32 becomes easy.

Furthermore, as shown in FIGS. 3 and 4, both end portions in a longitudinal direction, of each of the elliptical-shaped recess 40 formed in the vibration plate 30, are extended up to areas, respectively, each of the areas overlapping in a plan view with a substantially central portion of the circular-shaped ink inflow port 14*a* or overlapping in a plan view with a substantially central portion of the circular-shaped ink outflow port 14*b*, and the both end portions partially overlap with the ink inflow port 14*a* and the ink outflow port 14*a* respectively. Therefore, a flow of ink without stagnation is started in the pressure chamber 14, from the ink inflow port 14*a* along the longitudinal direction of the pressure chamber 14, up to the ink outflow port 14*b* via the recess 40. Accordingly, for example, even when an air bubble, entered and mixed in the ink when an ink cartridge is replaced, has entered the pressure chamber 14, the air bubble hardly remains in corners at both ends of the recess 40. The corners at the both end portions in the longitudinal direction of the recess 40 are positions at which a speed of the ink is the lowest in the recess 40. Therefore, the air bubble once reached at these positions is hardly moved from these positions, and remains there. However, in the first embodiment, the bubble included in the ink flow hardly reaches these positions. In other words, although an ink flow from the manifold 17 heading for the pressure chamber 14 is developed in the ink inflow port 14*a*, and an ink flow from the pressure chamber 14 heading for the nozzle 20 is developed in the ink outflow port 14*b*, these ink flows are more rapid than the flow of ink in the pressure chamber 14. Accordingly, any air bubble positioned inside the ink inflow port 14*a* and the ink outflow port 14*b* is dragged by the rapid flow of ink. Therefore, the air bubble is flowed out without reaching the corners at the both ends in the longitudinal direction of the recess 40. It is desirable that each of the two ends in the longitudinal direction of the recess 40 is positioned within a range from an end portion of the ink inflow port 14*a* on a side of the central portion of the pressure chamber 14 to a substantial center of the ink inflow port 14*a*, or within a range from an end portion of the ink outflow port 14*b* on a side of the central portion of the pressure chamber 14 to a substantial center of the ink outflow port 14*b*. Further, as shown in FIGS. 4 and 5, the recess 40 is shaped to be tapered toward a side of the piezoelectric layer. In other words, since an angle of the corner of the recess 40 is greater than 90°, the bubble hardly remains in the corner of the recess 40. A tapered angle of the recess 40 can be set to be a desired angle by adjusting processing conditions such as a speed of etching.

Thus, since the bubble hardly remains in the both end portions and the corner of the recess 40, it is possible to prevent, as much as possible, an adverse effect such that a part of the pressure applied to the ink in the pressure chamber 14 by the piezoelectric actuator 3 is absorbed by the bubble to cause a decrease in a speed and a volume of liquid droplets of the ink discharged from the nozzle 20.

Next, modified embodiments in which various changes are made in the first embodiment will be described. Same reference numerals are used for parts or components which have a substantially similar structure as those in the first embodiment, and the explanation of these parts or components is omitted as appropriate.

First Modified Embodiment

Figure 7:
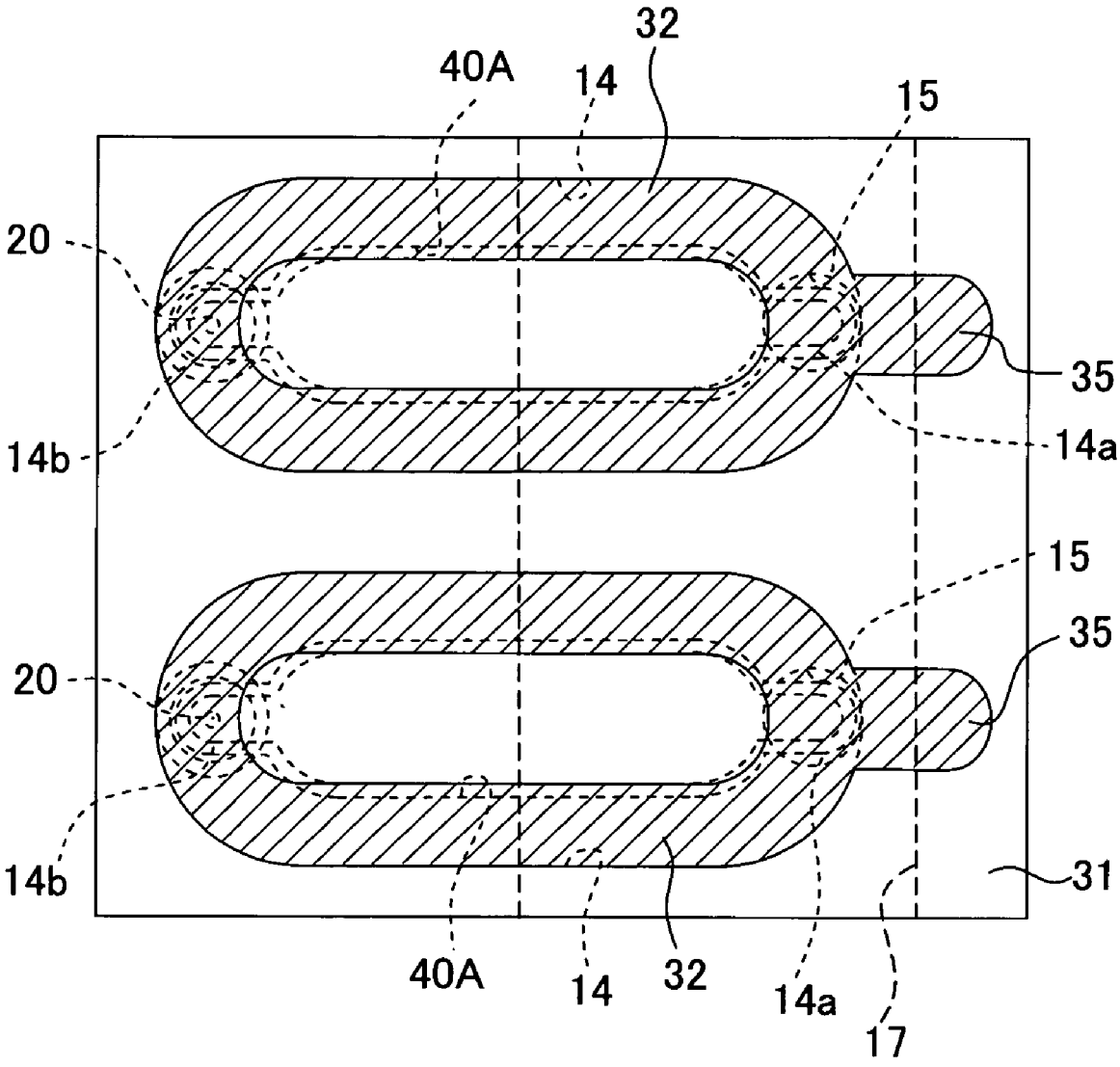
FIG. 7 is an enlarged plan view of an ink-jet head of a first modified embodiment.

As shown in FIG. 7, widths of both end portions of each of recesses 40A may be narrower as compared to a width of a central portion of the recess 40A, and the both end portions, of which width is partially narrowed, may overlap in a plan view with the ink inflow port 14*a* and the ink outflow port 14*b* respectively. In the embodiment shown in FIG. 3, the recess 40 is formed to overlap with a part of the driving zone A1 in which the individual electrode 32 is formed. However, in the first modified embodiment, a proportion occupied by the area, of the vibration plate 30, in which the recess 40A is formed can be decreased as compared to the first embodiment shown in FIG. 3. Deformation efficiency of the unimorph deformation adopted in the piezoelectric actuator 3 of the present invention depends on a ratio of stiffness of the vibration plate 30 and stiffness of the piezoelectric layer 31 in the driving zone A1. When the overlapping of the recess 40 with respect to the driving zone A1 is increased, the stiffness of the vibration plate 30 in the driving zone A1 is decreased. Therefore, the deformation efficiency of the piezoelectric actuator 3 is decreased. However, in the first modified embodiment, since it is possible to reduce the portion of the recess 40A overlapping with the driving zone A1, it is possible to maintain satisfactory deformation efficiency.

Second Modified Embodiment

Figure 8:
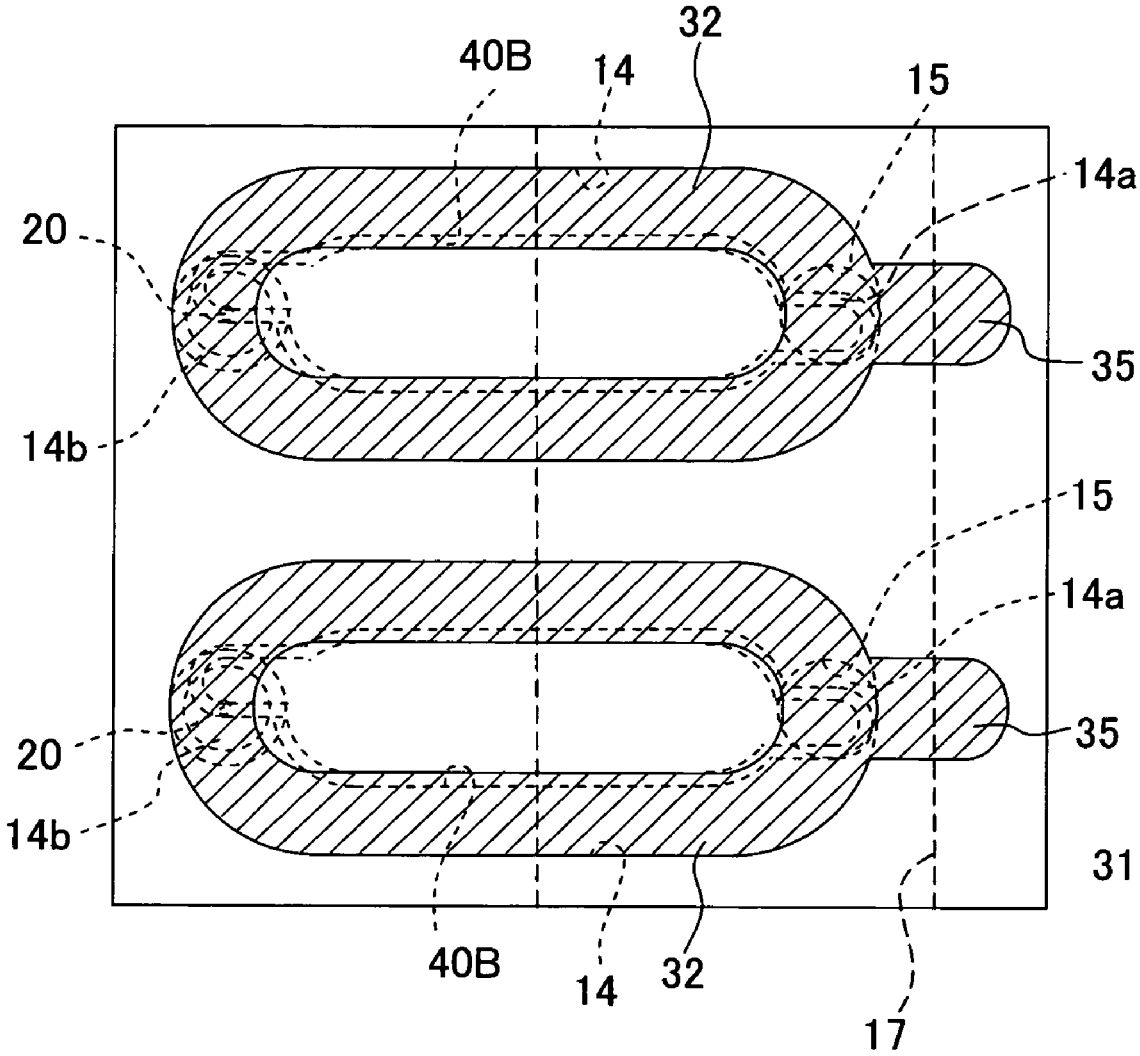
FIG. 8 is an enlarged plan view of an ink-jet head of a second modified embodiment.

Further, as shown in FIG. 8, both end portions, having a partially narrowed width, of each of recesses 40B may be arranged to partially overlap with the ink inflow port 14*a* and the ink outflow port 14*b*, respectively, in a state that the both end portions are offset toward one side (upper side or lower side in FIG. 8) in a direction orthogonal to the longitudinal direction of each of the pressure chambers 14, with respect to the ink inflow port 14*a* and the ink outflow port 14*b* respectively. The ink inflow port 14*a* and the ink outflow port 14*b* are arranged at both end portions, respectively, of each of the pressure chambers 14, and further, a direction of the ink flow in the vicinity of the ink inflow port 14*a* and the ink outflow port 14*b* is changed substantially at right angles from upward to leftward and from horizontally to downward, respectively, in FIG. 4. Therefore, a stagnation point at which a flow speed of the ink becomes slow locally is easily developed, and the air bubble entered into the pressure chamber 14 easily remains in the vicinity of the ink inflow port 14*a* and/or the ink outflow port 14*b*. However, according to a structure of the second modified embodiment, when the ink flows from the ink inflow port 14*a* to the recess 40B or when the ink flows from the recess 40B to the ink outflow port 14*b*, a vortex flow is easily developed. Therefore, as compared to the first modified embodiment as described above (see FIG. 7), the speed of the ink flow in the vicinity the ink inflow port 14*a* and the ink outflow port 14*b* is increased, and thus the bubble hardly remains.

In the second modified embodiment, the both end portions, having the partially narrowed width, of the recess 40B are arranged to be offset mutually oppositely in a short direction which is orthogonal to the longitudinal direction of the pressure chamber, with respect to the ink inflow port 14*a* and the ink outflow port 14*b* respectively. However, the both end portions may be arranged to be offset in the same direction. Further, only one of the both end portions having the partially narrowed width may be arranged to be partially overlapping with the ink inflow port 14*a* or the ink outflow port 14*b*, in a state that the only one end portion is offset toward one side in the short direction of the pressure chamber 14 with respect to the ink inflow port 14*a* or the ink outflow port 14*b*.

Third Modified Embodiment

Figure 9:
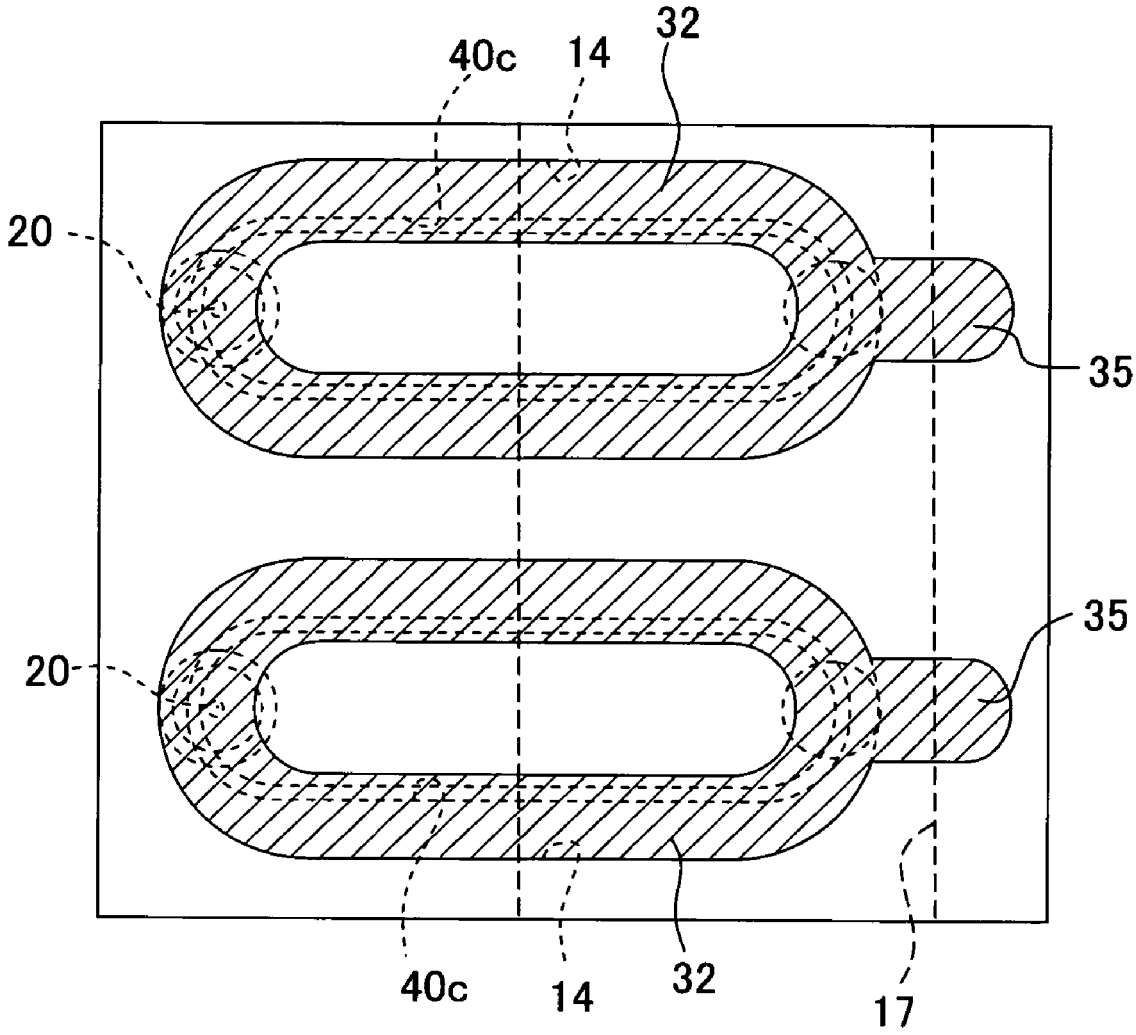
FIG. 9 is an enlarged plan view of an ink-jet head of a third modified embodiment.

As shown in FIG. 9, recesses 40C may be formed such that each of the recesses 40C is extended from an area overlapping with the central portion, of one of the pressure chambers 14, in which the individual electrode 32 is not formed, up to an area in which the individual electrode 32 is formed.

Fourth Modified Embodiment

Figure 10:
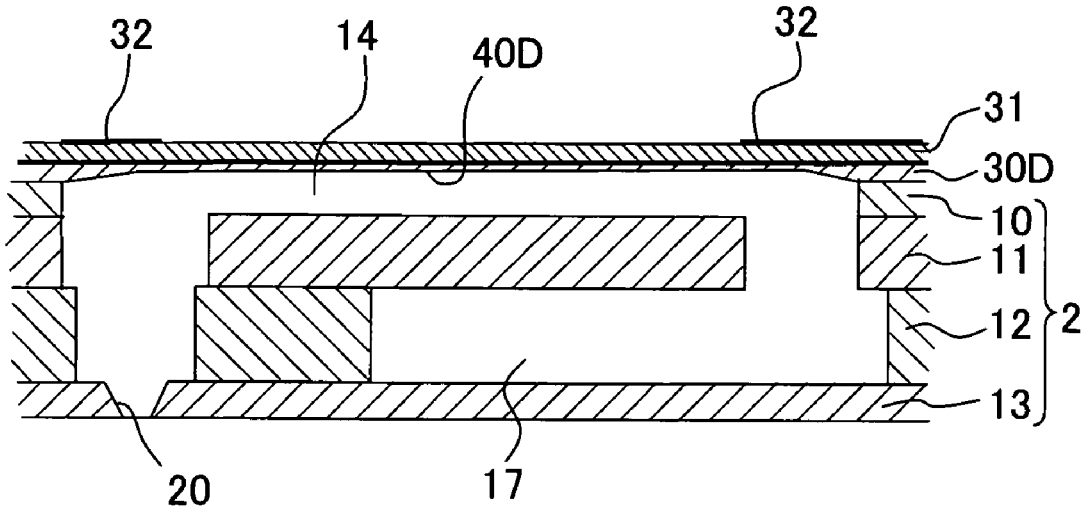
FIG. 10 is a cross-sectional view of a fourth modified embodiment, corresponding to FIG. 4.
Figure 11:
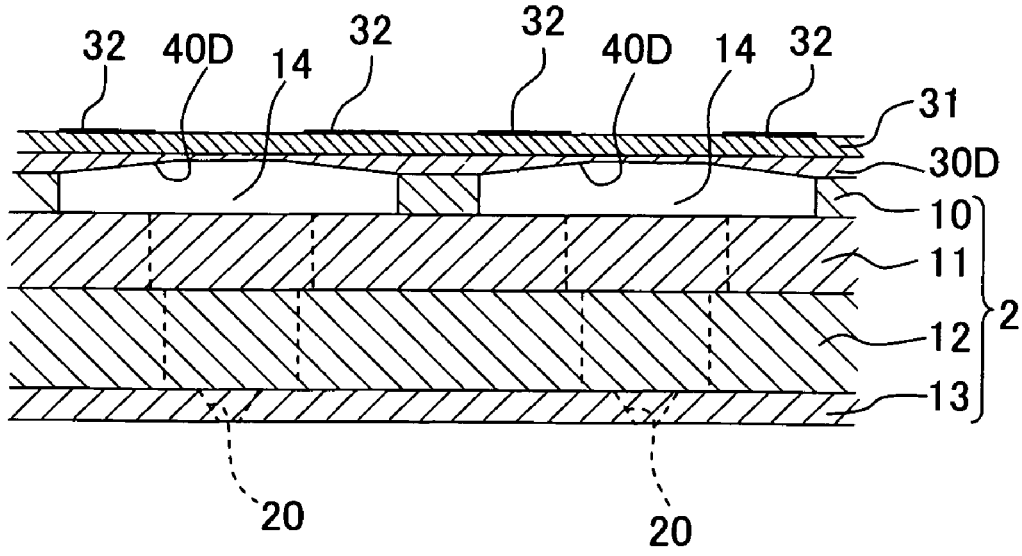
FIG. 11 is a cross-sectional view of a fifth modified embodiment, corresponding to FIG. 5.

As shown in FIG. 10 and FIG. 11, recesses 40D formed in a vibration plate 30D may be formed such that each of the recesses 40 extends up to an edge of one of the pressure chambers 14, and to have a tapered shape in which inclination (taper angle) is smaller than that of the tapered shape of the recess 40 of the first embodiment (see FIGS. 4 and 5). In this structure, an angle of a corner of each of the recesses 40D becomes wide, and the air bubble further hardly remains in the corner. The inclination of the recess 40D may be formed to be arch shaped, for example.

Fifth Modified Embodiment

Figure 12:
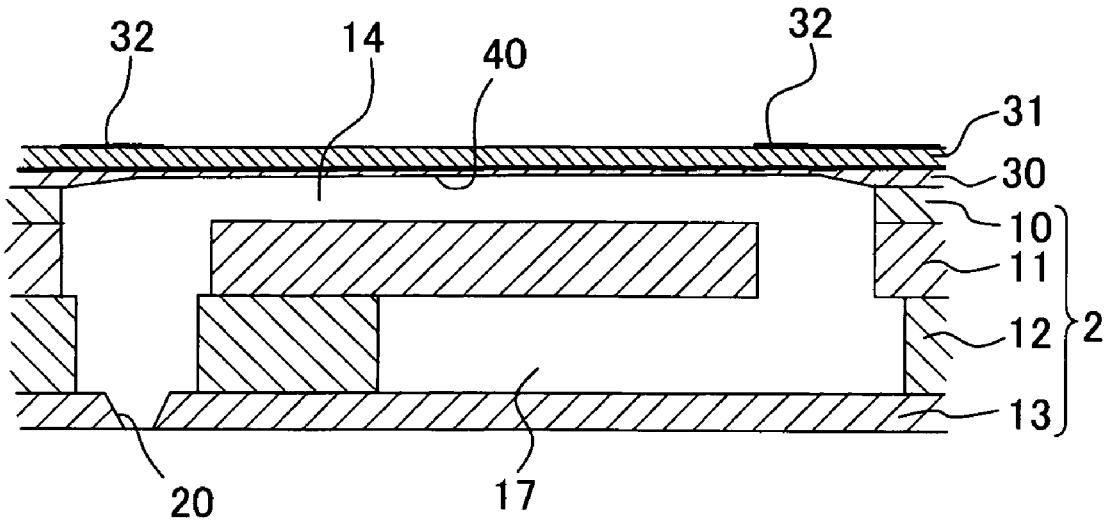
FIG. 12 is a cross-sectional view of the fifth modified embodiment, corresponding to FIG. 4.

It is not necessarily indispensable that the vibration plate 30 serve as the common electrode as in the piezoelectric actuator 3 of the first embodiment. As shown in FIG. 12, a common electrode 34 may be provided separately from the vibration plate 30. When the vibration plate 30 is a metallic plate, however, a space between the vibration plate 30 and the common electrode 34 needs to be insulated by an insulating material layer formed of an insulating material such as a ceramics material and a synthetic resin material. On the other hand, when the vibration plate 30 is made of an insulating material, the common electrode 34 can be formed directly on the upper surface of the vibration plate 30.

Sixth Modified Embodiment

It is not necessarily indispensable that a recess needs to overlap with both of the ink inflow port 14*a* and the ink outflow port 14*b*, and a satisfactory air-bubble discharge (purge) effect is achieved even in a case in which the recess overlaps with any one of the ink inflow port 14*a* and the ink outflow port 14*b*.

Seventh Modified Embodiment

The shape of a pressure chamber is not limited to the elliptical shape (oval shape). When the pressure chamber has a shape long in one direction such as a rhombus shape and a rectangular shape, the present invention is applicable also to such a case similarly as to the first embodiment. Further, it is not particularly required that the pressure chamber has a shape long in one direction, and the present invention can also be applied in a case in which the pressure chamber is circular shaped, square shaped, or the like.

Figure 13:
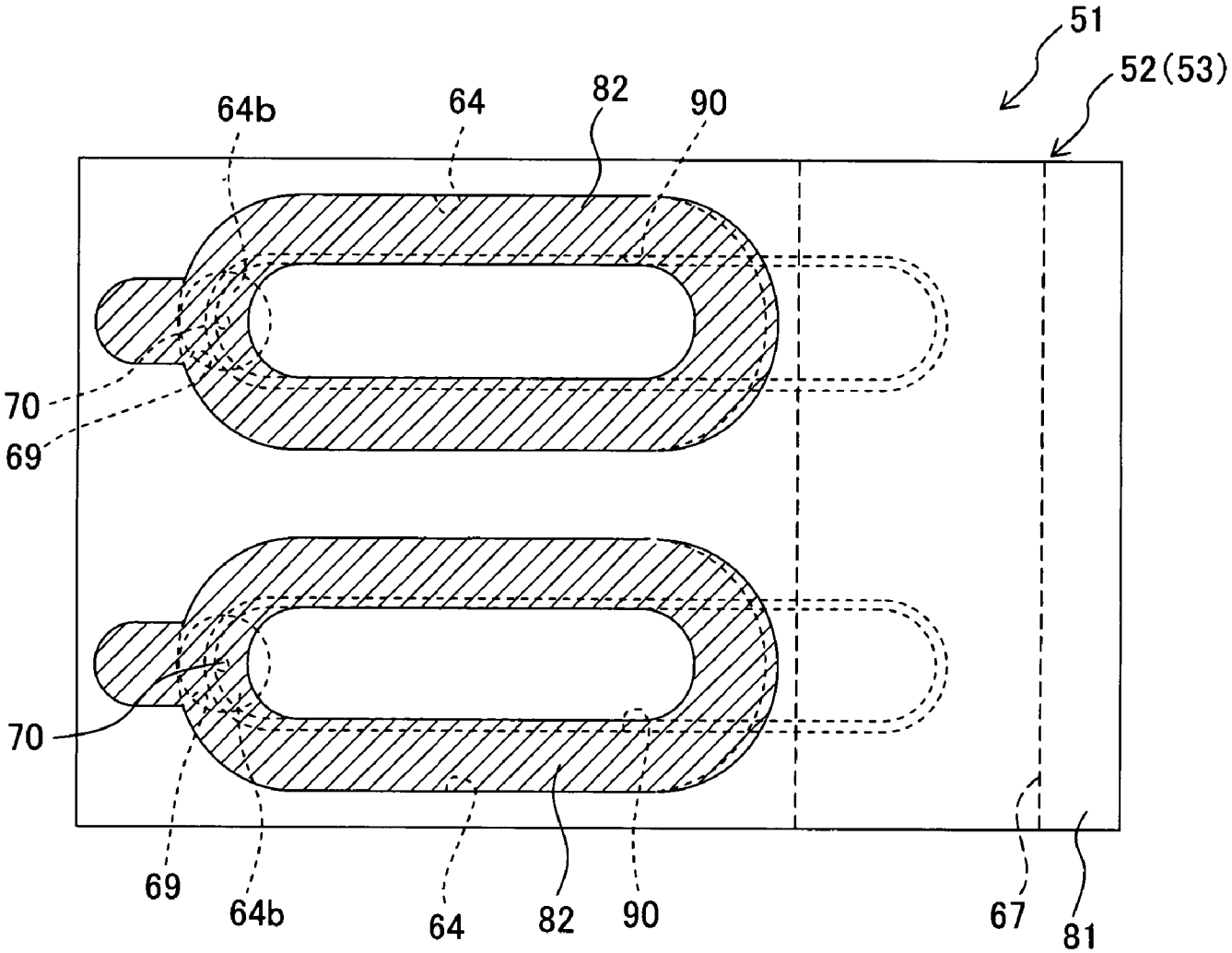
FIG. 13 is an enlarged plan view of an ink-jet head according to a second embodiment of the present invention.
Figure 14:
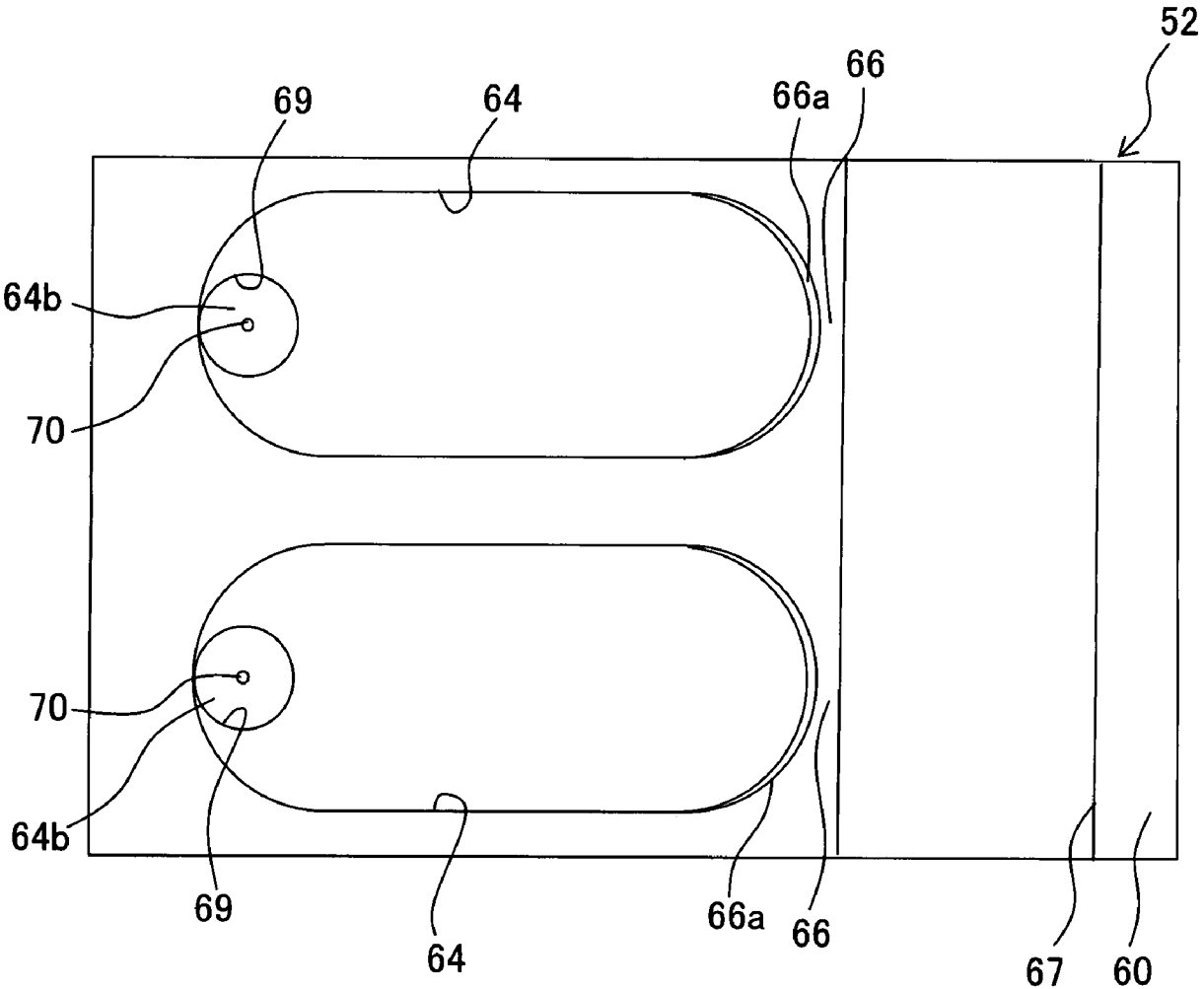
FIG. 14 is an enlarged plan view of a channel unit.
Figure 15:
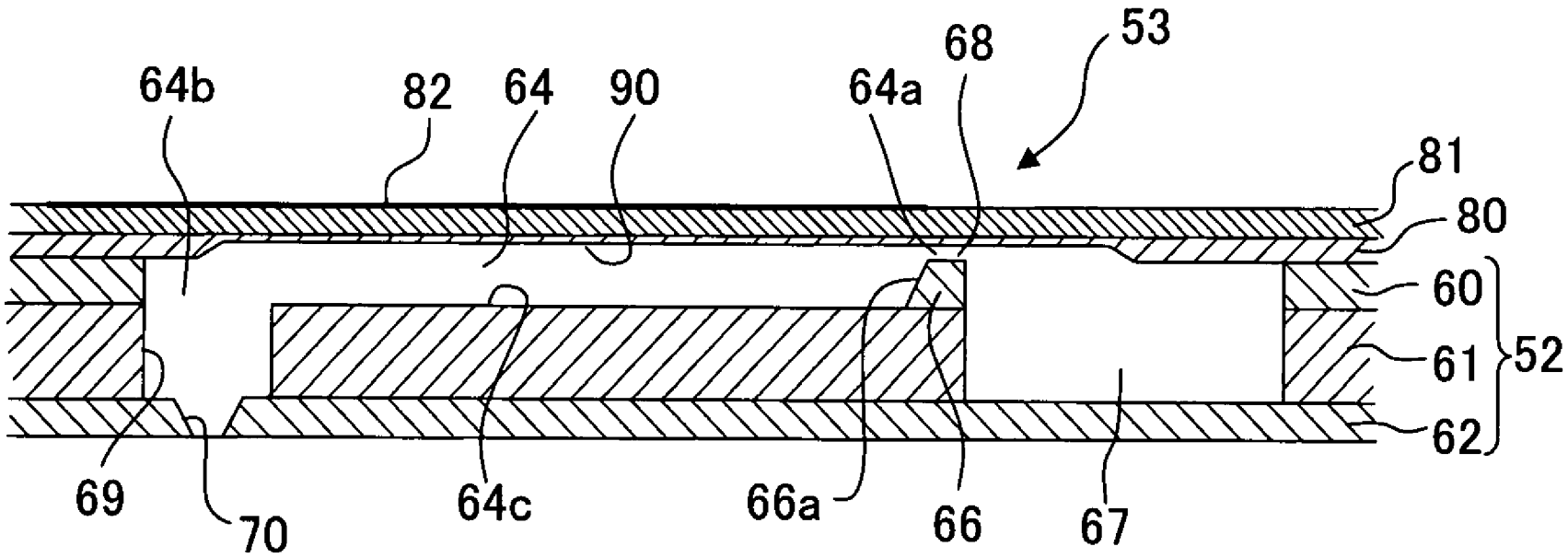
FIG. 15 is a cross-sectional view taken along a line XV-XV in FIG. 13.

Next, a second embodiment of the present invention will be described below. The second embodiment is another example in which the present invention is applied to an ink-jet head. As shown in FIGS. 13 to 15, an ink-jet head 51 of the second embodiment includes a channel unit 52 in which an ink channel including a plurality of pressure chambers 64 is formed, and a piezoelectric actuator 53 which is arranged on the upper surface of the channel unit 52.

As shown in FIG. 15, the channel unit 52 includes three plates, namely a cavity plate 60, a manifold plate 61, and a nozzle plate 62, and these three plates are joined in stacked layers. The cavity plate 60 and the manifold plate 61 are plates made of a metallic material such as stainless steel. Further, the nozzle plate 62 may be a plate made of a synthetic resin material such as polyimide, or may be a plate made of a metallic material same as the cavity plate 60 and the manifold plate 61.

The pressure chambers 64 which are arranged along a plane, similarly as in the first embodiment, are formed in the cavity plate 60. Each of the pressure chambers 64 has a substantially elliptical shape which is long in the scanning direction (left and right direction in FIG. 13) in a plan view. Further, a manifold 67 (common liquid chamber) extended in the paper feeding direction (up and down direction in FIG. 13) is formed in the cavity plate 60 and the manifold plate 61 below the cavity plate 60, at a position near one end portions (right end portions in FIGS. 13 and 14) in the longitudinal direction of the pressure chambers 64. A shape of the manifold 67 in a plan view is substantially the same as the shape of the manifold 17 in the first embodiment in a plan view, except that the manifold 67 is extended in the paper feeding direction and outside of the pressure chambers 64 in the scanning direction. The pressure chambers 64 and the manifold 67 are arranged adjacently, partitioned by partition walls 66 each of which defines one side surface (right side surface in FIGS. 13 and 14) of one of the pressure chambers 64. Further, as shown in FIG. 15, an ink inflow port 64*a* is formed between an edge of one end (on a side of the manifold 67) of each of the pressure chambers 64 and a vibration plate 80 which will be described later, and an ink outflow port 64*b* is provided at the other end of each of the pressure chambers 64. Furthermore, throttle channels 68 each of which communicates one of the pressures chamber 64 and the manifold 67 are formed between the partition walls 66 and the vibration plate 80. A side surface 66*a*, on the side of the pressure chamber 64, of each of the partition walls 66 is formed as an inclined surface inclined towards an inner side of the pressure chamber 64 in a direction away from the vibration plate 80. In other words, the side surface 66*a* is an inclined surface which makes an angle exceeding 90° (120°, for example) with a bottom surface 64*c* (surface on a side opposite to the vibration plate 80) of the pressure chamber 64. Therefore, ink flowed into the pressure chamber 64 via the throttle channel 68 is hardly stagnated in a corner between the side surface 66*a* of the partition wall 66 and the bottom surface 64*c* of the pressure chamber 64, and the air bubble hardly remains in this corner portion. Furthermore, communicating holes 69 are formed in the manifold plate 61 at positions each of which overlaps in a plan view with a left end portion in FIGS. 13 and 14 (ink outflow port 64*b*) of each of the pressure chambers 64. Moreover, nozzles 70 are formed in the nozzle plate 62 at positions each of which overlaps in a plan view with a central portion of one of the communicating holes 69.

Further, as shown in FIG. 15, the manifold 67 communicates with the ink inflow port 64*a* of each of the pressure chambers 64 via one of the throttle channels 68, and the ink outflow port 64*b* of each of the pressure chambers 64 communicates with one of the nozzles 70 via one of the communicating holes 69.

As shown in FIGS. 13 and 15, the piezoelectric actuator 53 includes the vibration plate 80 arranged on the upper surface of the channel unit 52, a piezoelectric layer 81 formed on the upper surface (surface on a side opposite to the pressure chambers 64) of the vibration plate 80, and individual electrodes 82 formed in an annular shape (ring shape) on the upper surface of the piezoelectric layer 81, corresponding to the pressure chambers 64 respectively. The piezoelectric layer 81 and the individual electrodes 82 have a substantially similar structure as those of the piezoelectric layer 31 and the individual electrodes 32 (see FIGS. 3 to 6) respectively, of the first embodiment, and therefore the description thereof is omitted.

The vibration plate 80 is joined to the cavity plate 60 to cover the pressure chambers 64. Here, recesses 90 each of which is extended in a longitudinal direction of one of the pressure chambers 64 are formed on a lower surface of the vibration plate 80, at areas each of which overlaps in a plan view with the central portion of one of the pressure chambers 64. The stiffness of the vibration plate 80 is reduced partially at a portion in which each of the recesses 90 is formed, and the vibration plate 80 is easily deformed at the portion formed with the recess 90. Therefore, the vibration plate 80 can be deformed substantially at a low drive voltage.

Further, one end (end on a side opposite to the manifold 67) of the recess 90 is extended up to a substantially central portion of the ink outflow port 64*b* of each of the pressure chambers 64, and overlaps partially with the ink outflow port 64*b* in a plan view. Therefore, the ink can flow from the recess 90 to the ink outflow port 64*b* without being stagnated, and even when an air bubble enters into the pressure chamber 64, this air bubble hardly remains near the ink outflow port 64*b*.

Furthermore, each of the recesses 90 formed on the lower surface of the vibration plate 80 is extended up to a substantially central portion, in a width direction, of the manifold 67 positioned further outside from each of the pressure chambers 64 in the scanning direction (side opposite to the nozzle 70 in the longitudinal direction of each of the pressure chambers 64). As shown in FIG. 15, the ink inflow port 64*a* is formed between the recess 90 and the end portion (end portion on a side of the manifold 67) of the pressure chamber 64, and the throttle channel 68 is formed between an upper surface of the partition wall 66 and a portion of the recess 90, the portion extending farther up to outside of the area overlapping with each of the pressure chambers 64. A channel height of the throttle channel 68 is equal to a depth of the recess 90, and a cross-sectional area of the channel is sufficiently narrow as compared to a cross-sectional area of the pressure chamber 64 and a cross-sectional area of the manifold 67. Further, due to a portion in which the channel cross-sectional area is narrowed partially between the pressure chamber 64 and the manifold 67, in other words, due to the throttle channel 68, a pressure wave generated in the pressure chamber 64 when the vibration plate 80 is deformed (vibrates) is hardly propagated to the manifold 67.

The channel cross-sectional area of the throttle channel 68 has an effect on the propagation of the pressure wave in the pressure chamber 64, and consequently has a substantial effect on ink-discharge characteristics such as the speed of liquid-droplet and the volume of liquid-droplet of the ink which is discharged from the nozzle 70. Therefore, the throttle channel 68 is required to be formed with considerable precision. However, in the ink-jet head 51 of the second embodiment, the throttle channel 68 is formed between a part of the recess 90 formed on the lower surface of the vibration plate 80 and the upper surface of the partition wall 66 of the cavity plate 60 (channel unit 52). Accordingly, only by forming the recess 90 with precision in the vibration plate 80, the throttle channel 68 is thus also formed with precision at the same time. Therefore, as compared to a case of forming the throttle channel 68 by a method such as the etching separately from the recess 90, the production process of the ink-jet head 51 can be simplified, and the yield is also improved.

The shape, number, and arrangement of the manifold and the pressure chamber in a plan view in the above-mentioned embodiments and the modified embodiments are exemplary, and the shape, number and arrangement of the manifold and the pressure chamber are not limited thereto.

Embodiments in which the present invention is applied to the ink-jet head are described by giving examples of the first embodiment and the second embodiment. However, embodiments to which the present invention is applicable are not limited to the first embodiment and the second embodiment. The present invention can also be applied to various liquid transporting apparatuses which transport liquids other than ink, for example.

What is claimed is:

1. A liquid transporting apparatus comprising:

a channel unit which is arranged along a plane, and in which a channel including a plurality of pressure chambers each having a liquid inflow port and a liquid outflow port is formed; and a piezoelectric actuator which is arranged on one surface of the channel unit, and which changes volume of the pressure chambers to apply a pressure to a liquid inside the pressure chambers, the piezoelectric actuator including:

a vibration plate which covers the pressure chambers, a piezoelectric layer which is arranged on a side of the vibration plate opposite to the pressure chambers, a plurality of individual electrodes each of which is arranged on one surface of the piezoelectric layer at an area overlapping with an edge portion of one of the pressure chambers as viewed in a direction orthogonal to the plane, the edge portion being an area other than a central portion of one of the pressure chambers, and a common electrode which is arranged on the other surface of the piezoelectric layer;

wherein recesses are formed on a surface of the vibration plate on a side of the pressure chambers at areas each of which overlaps with the central portion of one of the pressure chambers as viewed in the direction orthogonal to the plane.

2. The liquid transporting apparatus according to claim 1, wherein:

each of the pressure chambers is formed to extend in a predetermined direction;

the liquid inflow port and the liquid outflow port are provided at both end portions in a longitudinal direction, respectively, of each of the pressure chambers; and an end portion of each of the recesses in the longitudinal direction overlaps partially with one of the liquid inflow port and the liquid outflow port as viewed in the direction orthogonal to the plane.

3. The liquid transporting apparatus according to claim 2, wherein a width of the end portion of each of the recesses is narrower than a central portion of each of the recesses, and the end portion overlaps, as viewed in the direction orthogonal to the plane, with one of the liquid inflow port and the liquid outflow port, in a state in which the end portion of each of the recesses is offset toward one side in a direction orthogonal to the longitudinal direction with respect to one of the liquid inflow port and the liquid outflow port.

4. The liquid transporting apparatus according to claim 1, wherein the recesses are shaped to be tapered toward a side of the piezoelectric layer.

5. The liquid transporting apparatus according to claim 1, wherein:

the channel unit has a common liquid chamber communicating with the pressure chambers;

each of the recesses is extended up to an area which is outside of an area overlapping with one of the pressure chambers as viewed in the direction orthogonal to the plane; and a throttle channel, in which a channel area between the common liquid chamber and each of the pressure chambers becomes partially small, is formed between the one surface of the channel unit and a portion of each of the recesses, the portion extending up to the area outside of the area overlapping with one of the pressure chambers.

6. The liquid transporting apparatus according to claim 5, wherein:

the channel unit includes partition walls;

each of the partition walls forms the throttle channel between each of the partition walls and one of the recesses, and each of the partition walls defines one side surface of one of the pressure chambers; and a surface of each of the partition walls, which defines the one side surface of one of the pressure chambers, is an inclined surface inclined toward one of the pressure chambers in a direction away from the vibration plate.

7. The liquid transporting apparatus according to claim 1, wherein each of the individual electrodes is formed in an annular shape along the edge portion of one of the pressure chambers.

8. The liquid transporting apparatus according to claim 1, wherein the vibration plate is formed of an electroconductive material, and the vibration plate serves as the common electrode.

9. The liquid transporting apparatus according to claim 8, wherein the vibration plate is formed of a metallic material.

10. The liquid transporting apparatus according to claim 1, wherein the piezoelectric actuator increases volume of the pressure chambers when a predetermined voltage is applied to the individual electrodes.

11. An ink-jet printer comprising a liquid transporting apparatus as defined in claim 1.

* * * * *